US005359819A

United States Patent [19]

Beyler

[11] Patent Number: 5,359,819

[45] Date of Patent: Nov. 1, 1994

[54] SOUND AND VIBRATION DAMPING DEVICE BASED ON TIRES

[76] Inventor: Roland Beyler, 61 avenue du Maréchal Joffre, 94360 Bry sur Marne, France

[21] Appl. No.: 960,366

[22] PCT Filed: Jul. 23, 1991

[86] PCT No.: PCT/FR91/00604

§ 371 Date: Jan. 4, 1993

§ 102(e) Date: Jan. 4, 1993

[87] PCT Pub. No.: WO92/01837

PCT Pub. Date: Jun. 2, 1992

[30] Foreign Application Priority Data

Jul. 24, 1990 [FR] France ..... 90 09417

[51] Int. Cl.[5] ..... E04B 1/82

[52] U.S. Cl. ..... 52/144

[58] Field of Search ..... 256/1, 13.1; 52/144, 52/145, DIG. 9, DIG. 13; 404/6; 405/30

[56] References Cited

U.S. PATENT DOCUMENTS 3,951,384 4/1976 Hildreth ..... 256/1
4,785,577 11/1988 Lederbauer ..... 256/13.1

FOREIGN PATENT DOCUMENTS 2612217 9/1988 France .
7734600 11/1977 Germany .
3125579 7/1982 Germany .
3308651 9/1984 Germany .

*Primary Examiner*—James L. Ridgill, Jr.
*Attorney, Agent, or Firm*—Bachman & LaPointe

[57] ABSTRACT

The present invention relates to a sound and vibration damping device using unit structures comprised of tires, portions of tires or similar elements as far as the shape and absorbing characteristics of the material are concerned, characterized in that said unit structures (1) are arranged in at least one incombustible box (C1) so as to define elementary sound-deadening chambers, said box having a so called "front", wall (6) provided with openings (7) facing a noise source.

21 Claims, 3 Drawing Sheets

SOUND AND VIBRATION DAMPING DEVICE BASED ON TIRES

The present invention relates to a sound- and vibration-damping device using unitary structures consisting of tires, parts of tires or of elements equivalent in terms of the shape and absorbant nature of the material.

It applies more particularly to the production of noise-protection walls reusing worn-out tires.

Currently, worn-out and stored tires are destroyed by active combustion (fire) or by slow combustion (acid) entailing an intense atmospheric or land pollution requiring, in some cases, the evacuation of populations over a greater or lesser radius from the site of destruction. Dumping worn-out tires in rubbish dumps is in the process of being banned.

Attempts to use worn-out tires, for the construction of noise-protection walls, essentially consist in stacking them one on top of another or in juxtaposing them beside one another in order therefrom to make columns placed horizontally or vertically and joined loosely to one another (see for example DE-U-77 34,600).

Current worn-out tire-based noise-protection wall designs have two major drawbacks.

On the one hand, the sound-damping effect is rather limited insofar as these walls do not enable acoustic imperviousness to be achieved, especially due to the fact that they allow free spaces constituting acoustic paths to remain between the tires.

On the other hand, in the event of accidental or willful combustion triggered for example by an accident at a location of the tire wall, this combustion propagates uncontrollably to the entire wall, representing a considerable danger for the environment and the population.

Furthermore, such walls have an unesthetic appearance which acts as a deterrent against the installation thereof.

The present invention aims to provide a sound- and vibration-damping device of the aforementioned type, alleviating the abovementioned drawbacks, whilst improving the acoustic damping properties.

According to its main characteristic, the present invention relates to a sound- and vibration-damping device using unitary structures consisting of tires, parts of tires or of elements equivalent in terms of the shape and the absorbant nature of the material, characterized in that said unitary structures are disposed in at least one incombustible casing so as to delimit elementary anechoic chambers, said casing including a so-called "front" wall element provided with openings which are intended to face a noise source, By means of such a device, it becomes achievable first of all to eliminate all risks of propagation of a combustion to the entire noise-protection wall. This is because, since such a wall according to the invention consists, as will be seen hereinbelow, of a succession of casings in a vertical and/or horizontal disposition, a start of combustion of the unitary structures in one casing will be contained in this casing without the possibility of propagating to the adjacent casings.

In addition, since the structures are not visible from the outside, the esthetic appearance is determined by the casing wall elements which may be decorated or fitted-out at will as a function of esthetic requirements.

Furthermore, the fact of providing a disposition of the unitary structures so as to constitute elementary anechoic chambers enables an improved acoustic imperviousness to be achieved with respect to existing devices. This acoustic imperviousness is further increased by the interaction of the unitary structures with the wall elements of the casing.

This use of casings makes it especially possible advantageously to allow the unitary structures to be held tightly against one another or one on top of another, thus eliminating, with the wall elements of the casing, the acoustic paths which, in conventional embodiments, pass through the device.

The elementary anechoic chambers, constituted by the unitary structures, cause an acoustic-wave trapping effect arising from the shape of said structures.

In the rest of the description and in the claims, in order not to burden the text unnecessarily, the expressions "tires" and "half-tires" will designate not only actual tires and half-tires but also unitary structures which are equivalent in terms of shape and material.

According to particularly advantageous embodiments of the device according to the invention:

said parts of tires consist of half-tires obtained by cutting tires diametrally, said half-tires are disposed so as to have their open section facing said front wall element provided with openings so as to create an acoustic-wave focusing effect, conversely, said half-tires are disposed so as to have their tread facing said-front wall element provided with openings so as to create an acoustic-wave diverging effect.

In the latter case, said half-tires have perforations on their tread facing the noise source.

According to another embodiment of the device according to the invention for the use of whole tires:

said tires are disposed in contact with one another by their tread, one of their lateral faces facing the noise source; the device then advantageously includes perforated absorbant wheel-disks placed in the rim holes of said tires so as to promote the penetration and the trapping of the sounds inside the tires which constitute the elementary anechoic chambers, said wheel-disks causing, depending on their shape, an acoustic-wave diverging effect or an acoustic-wave focusing effect.

Advantageously, said front wall element provided with openings consists of a plate perforated with holes.

It is also possible to make provision, so as to organize the penetration of the acoustic waves, for making sound inlets replacing, at least partially, said holes.

The holes or sound inlets may advantageously be replaced or supplemented by shutters consisting of articulated or fixed strips substituting, or supplementing, said front wall element provided with openings.

According to other advantageous characteristics of the device according to the invention:

said casing consists of two lateral faces, a bottom, a rear or outer panel, a cover and said front wall element having openings, the latter being placed facing the noise source;

the device includes a first series of tires or parts of tires in contact with said front wall element provided with openings and a second series of tires or parts of tires, the two series of tires or parts of tires being separated by a wall element which is preferably absorbant and which defines, between itself and the rear panel, an anechoic chamber;

said half-tires are stacked one on top of another with their lateral faces in contact;

said device includes separation plates between two adjacent half-tires;

said separation plates have an absorbant alveolate structure;

said front wall element provided with openings has an absorbant alveolate structure;

the constituent elements of said casing are profiled in order to increase the rigidity thereof;

the wall elements and panels of said casing and/or the interior of the tires or parts of tires are coated with an absorbant material.

According to the invention therefore, the tires or parts of tires, worn-out or not, pierced or not, porous or not, are held tightly and piled up one on top of another or juxtaposed against one another, inside a box or casing made of metal or any other incombustible or fire-proof material, providing, by its cellular design, an effective fire barrier, one of the sides of which, facing the noise source, is pierced with orifices, each of these tires or parts of tires thus forming an elementary anechoic chamber and creating, depending on their disposition, focusing, diverging, refracting or diffracting effects for the incident reflected acoustic waves.

The present invention therefore enables tire-based noise-protection walls to be produced which perfectly fulfill objectives of safety against the propagation of a combustion of the tires and which constitute excellent acoustic imperviousness, the choice of the embodiment adopted being able to be determined by the sound level of the site to be insulated.

Tests have shown that the device according to the invention enables a average local absorption factor of 0.8 to be obtained for frequencies between 100 and 700 Hz which constitute typical frequencies along the highways, freeways and railroads, whereas the average local absorption factor for the same frequencies with a so-called "highly absorbant" material is of the order of 0.4.

Particular embodiments of the invention, which will make clearer the characteristics and advantages thereof, will now be described in more detail, it being understood that these embodiments are chosen by way of examples and that they are not limiting.

Their description is illustrated by the attached drawings, in which.

Figure 7:
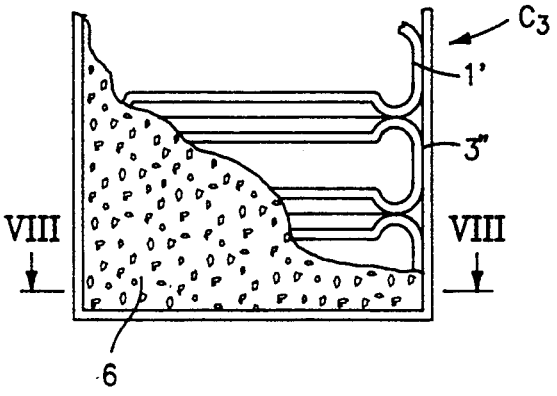
FIGS. 7 and 8 represent respectively from the front and in section, along the line VIII—VIII of FIG. 7, a third embodiment of the device according to the invention.
Figure 9:
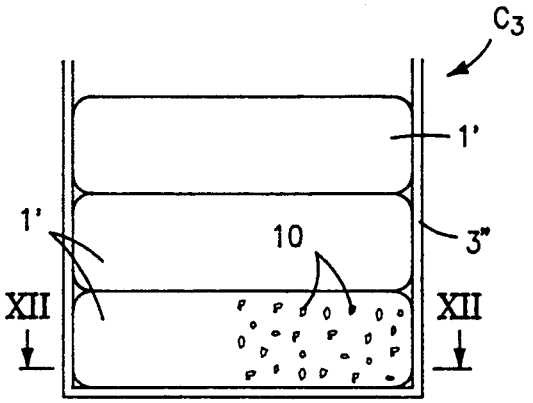
Figure 10:
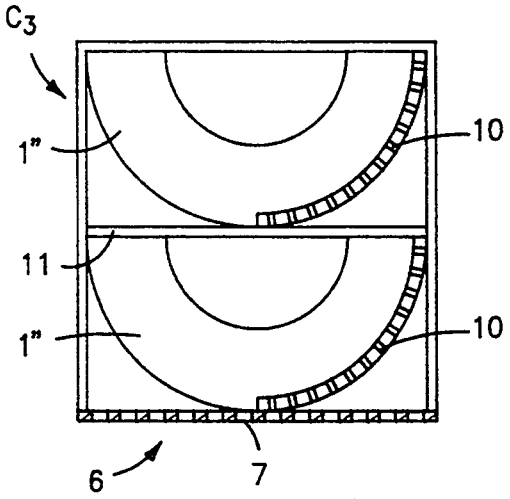
Figure 11:
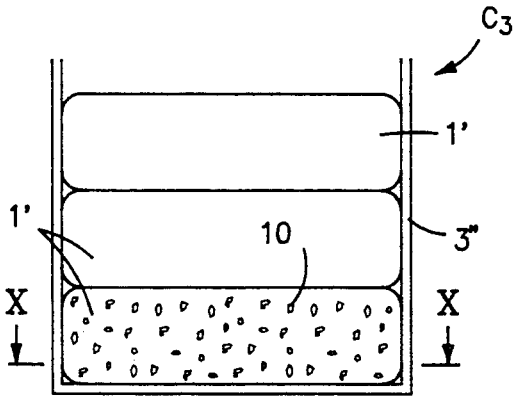
Figure 12:
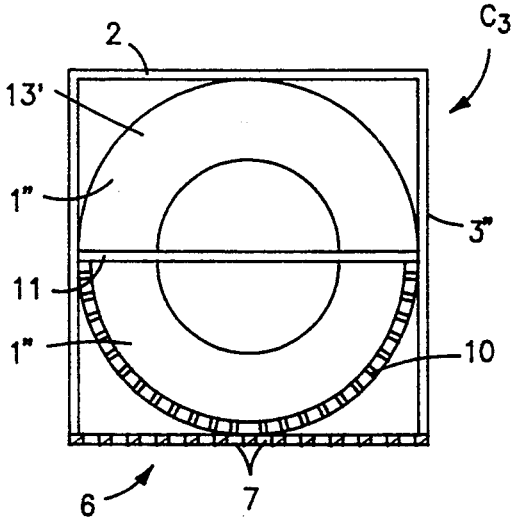
Figure 13:
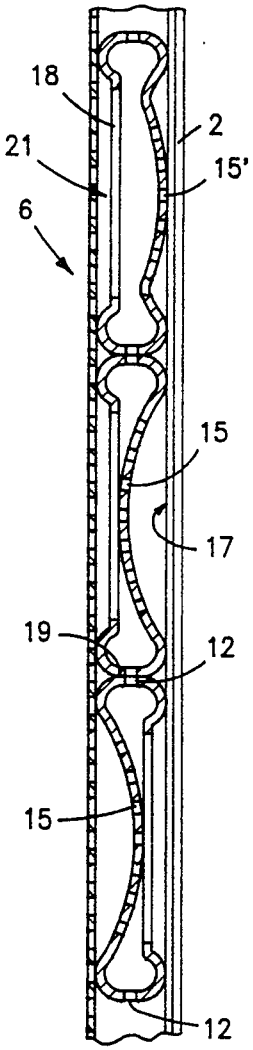
Figure 15:
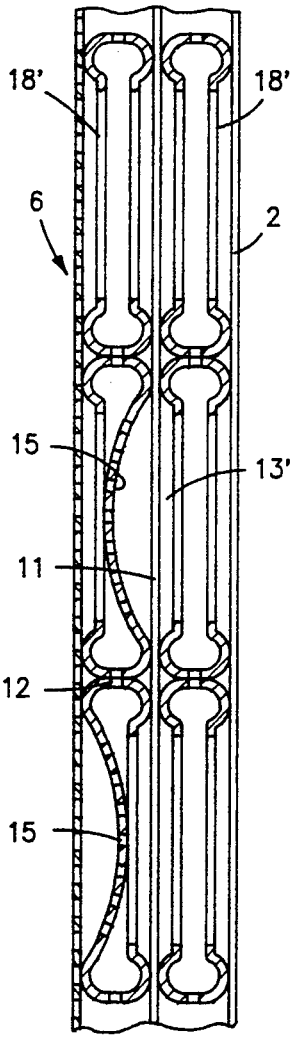
Figure 14:
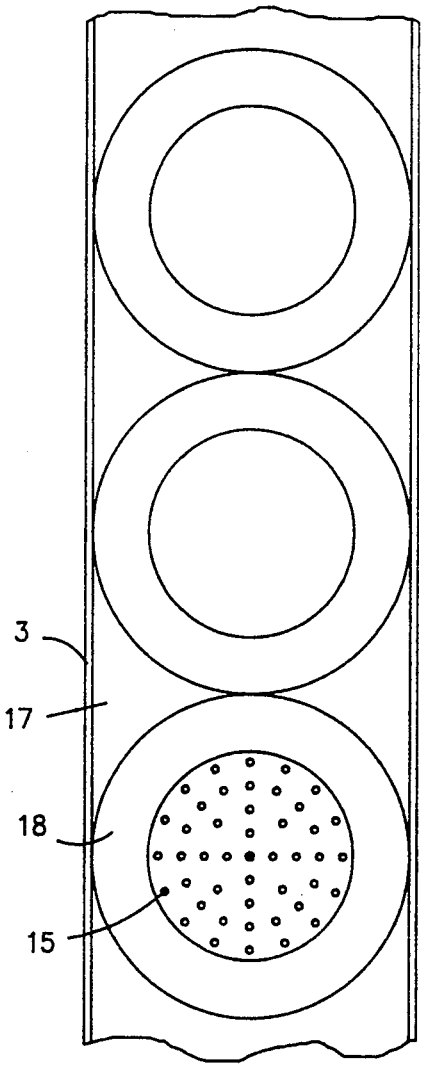

FIGS. 9 and 11 show a front view, with the front wall element omitted, of the alternative embodiments of the device represented in FIG. 7 and FIG. 10 and 12 are sections taken respectively along the lines X—X and XII—XII of FIGS. 9 and 11;

FIGS. 13 and 14 represent respectively in section and in front view, with omission of the front wall element, a fourth embodiment of the device according to the invention using whole tires; and FIG. 15 shows, in section, an alternative embodiment of the device represented in FIGS. 13 and 14.

In the figures, the same references are used for designating the same components. The same references, but supplemented with the "prime" or "double prime" symbol, designate similar components.

Figure 1:
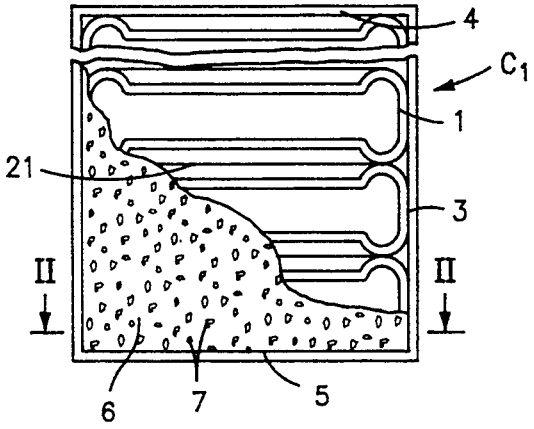
FIG. 1 is a front view of a first embodiment of a device according to the invention, the front wall element provided with openings being partially omitted.
Figure 2:
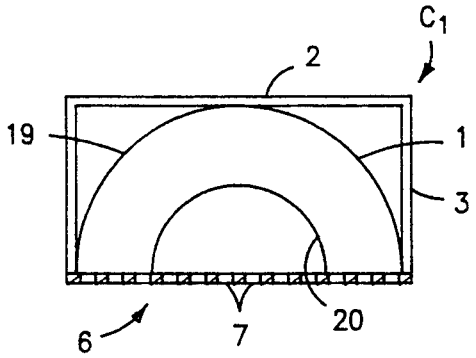
FIG. 2 is a sectional view along the line II—II of FIG. 1.

FIGS. 1 and 2 represent a casing C1 in which half-tires 1 or parts of tires are held and stacked up one on top of another in order to provide a perfect imperviousness with the rear panel 2, not pierced, and the lateral wall elements 3 of the casing C1. The tread 19 of the half-tires 1 is turned towards the rear panel 2 and the half-tires are in contact with one another by means of their lateral faces 21. The rear panel 2 and the lateral wall elements 3 may be, as the interior of the tires, coated with an absorbant material, each part of tire constituting an elementary anechoic chamber. The holding of the parts of tires tightly, against one another or one on top of another, constitutes a noise-protection volume in which the reflection of the acoustic waves is focused by the shape of the tire, each tire creating an independent or laminar focusing effect.

The draining of rain or washing water from the half-tires occurs by gravity.

One of the particular features of an assembly thus constituted is to provide a mechanical-vibration damping function and to attenuate the sound level generated by the passage of vehicles, cars, trucks, trains, etc., but also for the protection of the environment in the vicinity of a noisy area (factories).

It is clear that the lateral wall elements 3, the cover 4 and the bottom 5 of the casing C1 may be disconnected from all other components, which are made of metal or other material and are incombustible, providing the rigidity of the assembly, by flexible joints. The front panel 6, on the noise-source side, is perforated with holes 7, shutters or sound inlets of suitable shapes, in order to promote the penetration of the sound waves into the interior of the device. It may also be made of expanded metal. The panels and wall elements constituting the fire-barrier casing may be flat, corrugated, ribbed or having appropriate shapes for increasing the rigidity of the assembly.

Figure 3:
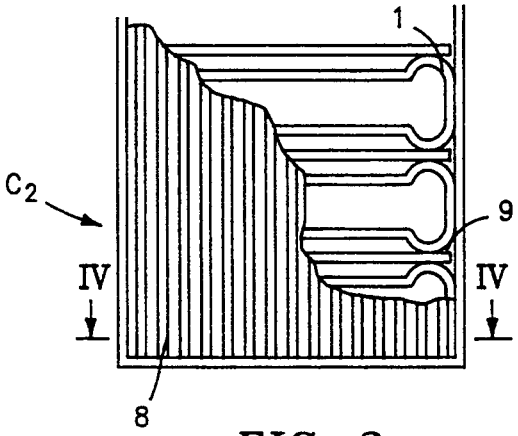
FIG. 3 shows an alternative embodiment of the device represented in FIG. 1.
Figure 4:
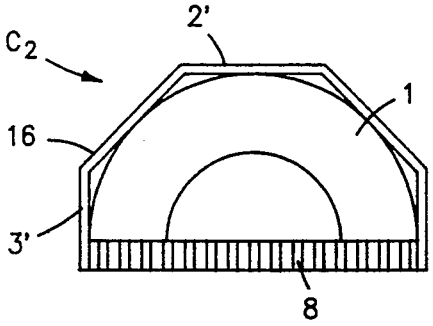
FIG. 4 is a section along the line IV—IV of FIG. 3.

FIGS. 3 and 4 are similar views to the previous ones but, this time, the casing C2 has a rear panel 2' joined to the lateral wall elements 3' by oblique intermediate wall elements 16 so that the casing C2 has, in cross-section, a trapezoidal part. Axial or inclined shutters 8 and separation plates 9 made from absorbant material have been judiciously disposed, the first 8 on the front face of the casing C2, the second 9 between the half-tires 1, so that the reflected waves focused by the shape of the tires, encounter absorption surfaces as large as possible. It is clear that the panel where the shutters 8 are fixed can replace or supplement the perforated panel 6 of FIGS. 1 and 2. The shutters 8 and the plates 9 may be replaced by an absorbant alveolate structure or any equivalent structure.

Figure 5:
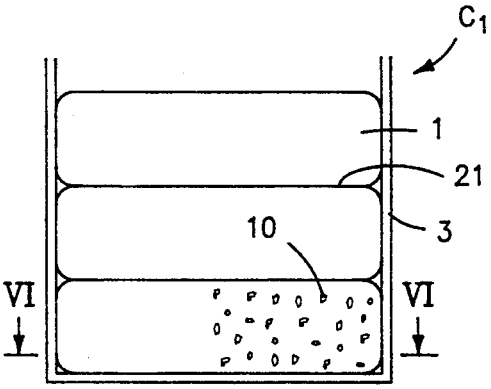
FIG. 5 is a front view of a second embodiment of the device according to the invention, with omission of the front wall element.
Figure 6:
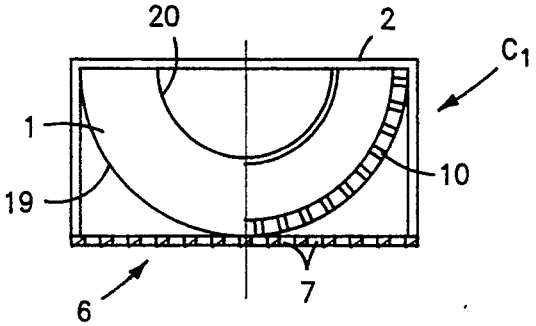
FIG. 6 is a sectional view along the line VI—VI of FIG. 5.

FIGS. 5 and 6 show half-tires 1, pierced or not, porous or not, according to another method of installation, put into place in the fire-barrier casings C1 with their tread 19 on the front-face side of the casing and their open section 20 on the rear-panel side in order to create a divergent reflection of the acoustic waves. The half-tires, porous or pierced with orifices 10, enable one part of the sound to be channelled into the interior of the tire, the other part being reflected by a diverging effect.

Figure 8:
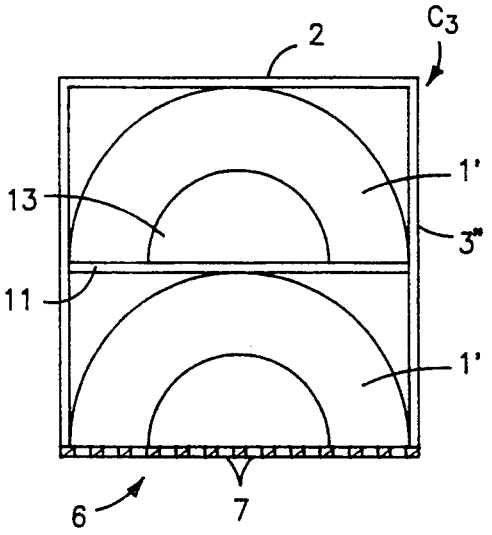

FIGS. 7 and 8 show an installation method corresponding substantially to a duplication of that of FIGS. 1 and 2: two columns of half-tires 1' and 1'' are juxtaposed and separated by a wall element 11, porous or absorbant, which is held against the lateral wall elements 3'' of the fire-barrier casing C3, the half-tires 1' being preferably porous or pierced so that the acoustic waves coming in contact with them are trapped within the anechoic chamber 13, by transmission or reflection, the non-absorbed part of the waves being reflected by a focusing effect.

FIGS. 9 and 10 present an installation method corresponding substantially to a duplication of that of FIGS. 5 and 6, which duplication is similar to that of FIGS. 7 and 8.

FIGS. 11 and 12 show a hybrid installation method between that of FIGS. 9 and 10 and that of FIGS. 11 and 12: instead of being oriented in the same manner, the half-tires 1' and 1'' are oriented in opposite directions.

FIGS. 13 and 14 present the mounting of whole tires 18 in a vertical stack between the rear 2 and front 6 panels. The tires 18 are in contact with one another by means of their tread 19 and one of their side surface 21 faces the noise source. The central parts of the tires may receive absorbant wheel-disks which are flat, concave 15 or convex 15', or which are of any other shapes promoting the penetration of the sounds towards the interior of the tires, by a diverging or focusing effect produced by the shape of the wheel-disks, a porous or absorbant wall element 17 being placed against the rear panel 2 so as to provide the transmitting and absorbing effect between the tires.

The draining of rain or washing water is provided by the orifices 12 made in the treads.

FIG. 15 presents an installation method similar to the previous one, but with two juxtaposed columns of whole tires 18' and 18'', the wheel-disks 15 preferably being pierced so as to permit the passage of the sounds up to the absorbant wall element 11, the volume behind this wall element, which encloses the second column of tires 18'', acting as the anechoic chamber 13'.

It is clear that the possibilities for superpositions or of juxtapositions of the tires or parts of tires, or of any other absorbant unitary structure of similar shape, inside a fire-barrier casing or box, as an anechoic-chamber element, with an acoustic-wave focusing or diverging effect, are not limited to those described hereinabove and that the other dispositions employing the same elements, which would only follow therefrom or be consequent thereof, are within the scope of the present patent.

The fire-barrier casings or boxes, thus constituted, juxtaposed beside one another, constitute a noise-protection wall which may be constructed vertically or inclined.

One of the methods for installing the noise-protection walls, along the edge of highways, freeways and railroads, may consist, for example, of the fixing of the juxtaposed fire-barrier casings, firmly attached to one another, to a flat or profiled transverse member placed at a minimum of $\frac{2}{3}$ of the height, laterally, on the rear panel 2 of the casings, and fixed to posts anchored in the ground, it being possible for this transverse member to be reinforced by a strut.

I claim:

1. A unitary acoustic device for damping vibrations, sound and undesirable noise comprising:

an incombustible casing having a plurality of wall elements defining a container, a first wall element having a plurality of openings communicating with the interior of the container, at least two automotive tires, each said tire being divided into at least two parts, each said tire part having an exterior tread portion and a hollow interior portion, said tire parts being arranged in vertical stacks sandwiched in close contact within said container so that the hollow interior portion of each tire part faces the openings of said first wall element whereby when the first wall element of said container is exposed to a source of vibrations, sound or undesirable noise, the hollow interior portion of each tire part is operative to focus acoustic waves thereby damping vibrations, sound or undesirable noise.

2. The device of claim 1 in which the casing is formed with a central porous partition dividing the casing into two compartments and each compartment contains a stack of said tire parts whose hollow interior portions face said first wall element and said partition, respectively.

3. The device of claim 1 in which said tire parts define half-tires obtained by cutting said tires diametrically.

4. The device of claim 1 in which the openings in said first wall element define elongated slots effective to direct and to promote penetration of sound waves into the interior of the casing.

5. The device of claim 4 in which the elongated slots are disposed vertically.

6. An acoustic device for damping sound and vibration comprising:

an incombustible casing having a plurality of wall elements, a first wall element having a plurality of openings, a set of vibration damping units each comprising at least a part of a vehicular tire, each tire part having an apertured tread portion, a hollow interior portion, a side wall portion, and a rim hole portion, said tire parts being disposed within said casing in stacked array so that one of said tread portion, said hollow interior portion, said side wall portion and said rim hole portion faces said first wall element whereby said tire parts are operative acoustically to damp sound and vibration waves entering said first wall element.

7. The device of claim 1 wherein the casing includes a plurality of incombustible castings thereby limiting the spread of flame from casing to casing.

8. The device of claim 6 wherein the side wall portion faces said first wall element.

9. The device of claim 6 wherein the rim hole portion faces said first wall element.

10. The device of claim 6 wherein each tire part comprises a half tire.

11. The device of claim 6 wherein the tread portion faces said first wall element.

12. The device of claim 11 wherein said tire parts are stacked so that the side wall of one tire part is in intimate contact with the side wall of an adjacent tire part.

13. The device of claim 6 wherein the hollow interior portion faces said first wall element.

14. The device of claim 13 wherein said tire parts are stacked so that the side wall of one tire part is in intimate contact with the side wall of an adjacent tire part.

15. The device of claim 6 wherein each tire part comprises a whole tire.

16. The device of claim 12 wherein said tires are stacked so that the tread portion of one tire is in contact with the tread portion of an adjacent tire.

17. The device of claim 16 wherein the tread portions of both tires in the region of said contact are formed with contiguous drain holes.

18. The device of claim 15 wherein the side wall faces the first wall element and the rim hole is fitted with a perforated disk.

19. The device of claim 15 wherein the disk is flat.

20. The device of claim 15 wherein the disk is formed with a convex contour and the convex contour faces the first wall element.

21. The device of claim 15 wherein the disk is formed with a concave contour and the concave contour faces the first wall element.

* * * * *

UNITED STATES PATENT AND TRADEMARK OFFICE

CERTIFICATE OF CORRECTION

PATENT NO. : 5,359,819

DATED : November 1, 1994

INVENTOR(S) : Roland Beyler

It is certified that error appears in the above-indentified patent and that said Letters Patent is hereby corrected as shown below:

In Column 6, claim 7, line 53, change the dependency from "claim 1" to --claim 6--.

In Column 7, claim 16, line 6, change the dependency from "claim 12" to --claim 15--.

In Column 8, claim 19, line 4, change the dependency from "claim 15" to --claim 18--.

In Column 8, claim 20, line 5, change the dependency from "claim 15" to --claim 18--.

In Column 8, claim 21, line 8, change the dependency from "claim 15" to --claim 18--.

Signed and Sealed this

Thirtieth Day of January, 1996

*Attest:*

Bruce Lehman

BRUCE LEHMAN

*Attesting Officer*

*Commissioner of Patents and Trademarks*